United States Patent [19]

Beavon

[11] 4,017,383

[45] Apr. 12, 1977

[54] SOLVENT DEASPHALTING PROCESS BY SOLVENT RECOVERY AT STAGED PRESSURES

[75] Inventor: David K. Beavon, Pasadena, Calif.

[73] Assignee: Ralph M. Parsons Company, Pasadena, Calif.

[22] Filed: May 15, 1975

[21] Appl. No.: 577,694

[52] U.S. Cl. ..... 208/309; 196/14.52; 208/321

[51] Int. Cl.[2] ..... C10G 21/14

[58] Field of Search ..... 208/309, 321

[56] References Cited

UNITED STATES PATENTS

| | | | |
|---|---|---|---|
| 2,010,007 | 8/1935 | Bray | 208/309 |
| 2,850,431 | 9/1958 | Smith | 208/309 |
| 3,202,605 | 8/1965 | Redcay | 208/309 |

*Primary Examiner*—Herbert Levine
*Attorney, Agent, or Firm*—Christie, Parker & Hale

[57] ABSTRACT

The energy requirements of a process for the solvent extraction of hydrocarbons from residua are reduced by nearly 50%, and capital requirements reduced substantially by evaporating solvent from extracted hydrocarbons in two or more pressure stages, the first stage evaporation occurring at a pressure sufficiently high to permit condensation of the solvent at a temperature sufficient to be combined with the solvent feed to the extractor at the required extraction temperature.

7 Claims, 2 Drawing Figures

SOLVENT DEASPHALTING PROCESS BY SOLVENT RECOVERY AT STAGED PRESSURES

BACKGROUND OF THE INVENTION

The present invention is directed to recovery of hydrocarbons from residual feedstock by differential solution in a selective solvent. Examples of residual feedstocks are residual oils from distillation of petroleum as well as residua derived from tar sands and the destructive distillation or hydrogenation of coal.

The necessity for the economic recovery of hydrocarbon values from these residua is becoming ever important in light of the increased shortage of hydrocarbon reserves.

Solvent deasphalting as the general process is more commonly known, involves the separation of petroleum residua into an asphalt fraction which contains most or all of the very high molecular weight compounds, metal-containing compounds, and inorganic matter, and a deasphalted, normally paraffinic oil fraction which is relatively free of asphalt and metals.

Deasphalting is particularly useful in converting high-sulfur petroleum residue to low-sulfur fuel oil, since removal of the asphalt fraction makes the deasphalted oil amenable to catalytic hydrodesulfurization. If left in the residue these constituents will foul and deactivate the hydrodesulfurization catalyst.

In the practice of deasphalting, a low-molecular weight hydrocarbon typically an aliphatic hydrocarbon is mixed with the feedstock, resulting in precipitation of the asphalt fraction with a minor portion of the solvent, while the more soluble deasphalted oil is extracted as a low-density solution in the major portion of the solvent. Solvents used include among others, propane, isobutane, normal butane, pentane, hexane, and heptane, and mixtures thereof.

To achieve the desired separation it is necessary to employ a relatively large volume of solvent. The normal practice is to circulate from four to ten volumes of solvent to an extractor for each volume of feed. It is, therefore, necessary to evaporate and condense the solvent used in the deasphalting circuit. As a consequence large amounts of energy are needed for heating and cooling.

In a conventional practice of deasphalting, the solvent and residue feed are mixed in the extractor. The operation may be co-current or countercurrent. Extraction vessels may be packed or stirred. More than one extractor may be used in parallel or in series.

The extractor is operated at a moderately elevated temperature relative to the circulating temperature of the solvent, and at pressure sufficient to avoid vaporization of solvent.

When a deasphalted oil mix and asphalt mix leave the extractor, the deasphalted oil mix contains most of the solvent. The deasphalted oil mix is reduced in pressure by a pressure reduction valve, then heated in a heat exchanger to evaporate the solvent. The solvent vapors are separated from deasphalted oil in a flash drum. The pressure on the flash drum is selected for a subsequent condensing step. Liquid deasphalted oil is separated from the flash drum. Still containing a minor amount of solvent, the oil is steam stripped of residual solvent.

The asphalt mix from the extractor containing approximately equal volumes of solvent and asphalt is heated in an asphalt mix heater to a temperature suitable to strip out the solvent and reduce the viscosity of the asphalt portion to a workable range. The pressure is further reduced by a second expansion valve to favor evaporation of solvent. Vapors are separated in an asphalt flash drum and final traces of solvent steam stripped in an asphalt stripper.

Vapors from the flash drums are combined with the vapors from the strippers and condensed by heat exchange with a coolant usually water. When propane is the solvent, or part of the solvent mixture, it is convenient to operate the strippers at a lower pressure than the flash drums. In this case it is customary to compress the vapors removed from the strippers to return them into the common condensing system. Owing to restrictions imposed by cooling with water or air, the condensed solvent temperature is normally in the range from 80° F to 140° F.

Condensed solvent is accumulated in a solvent accumulator and recirculated to the extractor by a solvent pump.

The recirculated solvent is in these operations completely distilled by an external energy source in each circuit of the system. Since its volume is conventionally from four to ten times the volume of feed, considerable heat is required in a solvent heater, the deasphalted oil mix heater and the asphalt mix heater. It is customary to use steam as the heating medium for the solvent and deasphalted oil mix heaters, and a fired heater for the asphalt mix heater. In a typical case, the solvent heater requires almost half of the heat of the process.

SUMMARY OF THE INVENTION

According to the present invention, there is provided improvements in deasphalting processes for the solvent recovery of hydrocarbons from crudes which reduce up to about 50% of the heat requirements of the processes.

The processes to which the invention is applied are those in which a hydrocarbon feed, such as petroleum residue, and residua derived from the processing of tar sands, shale oil, the destructive distillation or hydrogenation of coal and the like are processed in an extraction zone in the presence of a relatively low molecular weight solvent, such as propane, butane, pentane, hexane, heptane, and the like as well as mixtures thereof at an elevated temperature and at a pressure sufficient to maintain the solvent in a liquefied state. The extraction processes leads to the formation of a purified liquid hydrocarbon oil-solvent mixture and a fluid heavy hydrocarbon-solvent mixture.

The heavy hydrocarbon-solvent mixture is, in substance, a fluid precipitant of an asphalt layer with a minor portion of solvent which contains, in addition to high molecular weight hydrocarbons, metal containing compounds and inorganic matter. The hydrocarbon oil fraction is relatively free of asphalt and the metal salts and normally paraffinic.

Following the extraction to form the two fluid mixtures at the temperature and pressure employed in the extraction zone, the mixtures are separated and processed for recovery of the solvent by various evaporation and stripping techniques. The solvent recovered is in a relatively cool state and must be reheated for recycle back to the extraction zone.

In accordance with the practice of this invention, to minimize the heat requirements for the recycle solvent, at least a portion of the hydrocarbon oil-solvent mixture is heated to a temperature above the temperature in the extraction zone in a separate vaporization zone and vaporized.

The residual solvent contained in the hydrocarbon oil-solvent mixture and the heavy hydrocarbon solvent mixture is recovered by conventional means and is relatively cool as compared to the extraction zone temperature.

The vaporized solvent from the vaporization zone is combined with the recycled pressurized cooled solvent, and, by condensation of the evaporated solvent, raises the temperature of the blend, at least to a substantial degree to the temperature required for introduction to the extraction zone.

While that temperature achieved may be that required by the extraction zone, the pressure achieved by condensation may be less and augmented by increasing the pressure by virtue of pumping action from an accumulation zone ahead of the extraction zone. Further, if only a substantial portion, i.e. 50% or more, of the heat is provided by condensation of solvent vapors, a small amount of auxiliary heating may be employed to account for the balance.

For a typical operation and in accordance with the practice of the invention, the volume ratio of solvent to feed is normally about 4 to about 10. While extraction temperatures can vary widely, typical temperatures are from about 200° to about 250° F. The pressures employed in the extraction zone are above the bubble point of the solvent employed.

In the practice of the invention, the pressure at which solvent is evaporated is at least sufficient to provide a driving force to enable the vaporized solvent to flow and combine with the relatively cool solvent, the pressure differential typically being from about 1 to about 50 psi. Preferably, solvent is evaporated at a pressure above the extraction zone pressure. This occurs in a high temperature, high pressure evaporation zone.

The amount of solvent evaporated is dependent upon the temperature of the relatively cooled recycle solvent which is typically in the order of 80° to 140° F. The volume of solvent evaporated is sufficient such that the heat release upon condensation will provide at least 50% of the heat required to heat the recycled solvent to a temperature consonant with the feed temperature requirements of the extraction zone. Preferably, the net temperature achieved is the temperature in the extraction zone. If less, then all of the heat is provided by solvent condensation, the balance of the heat may be provided by a small auxiliary heater ahead of the extractor.

To carry out the process of this invention, there is added a means to heat the high pressure hydrocarbon oil-solvent mixture to the temperature at which evaporation is to occur in the high temperature, high pressure evaporation zone. A high pressure booster pump is also added, before and/or after the high pressure evaporation zone, for the purpose of returning solvent to the extraction zone.

THE DRAWINGS

DESCRIPTION

According to the present invention, a substantial portion or all of the heat necessary for solvent preheating can be recovered by the modification to the conventional deasphalting process through the strategic addition of the deasphalted oil mix pump, preheater and high pressure flash drum to create an initial high pressure solvent evaporation stage. The deasphalted oil mixture is heated to evaporate the solvent preferably at a temperature and pressure above that in the extractor. A pre-selected amount of solvent is evaporated from the deasphalted oil. The evaporated solvent is condensed at a temperature and pressure suitable for use in preheating cold solvent for introduction to the solvent extraction zone generally operated at a temperature from about 200° to about 250° F and at a pressure above the dew point of the solvent employed. In the case of a solvent such as isobutane, the operating temperature would be from about 220° to about 240° F at a pressure ranging from about 330 to about 400 psia.

Figure 1:
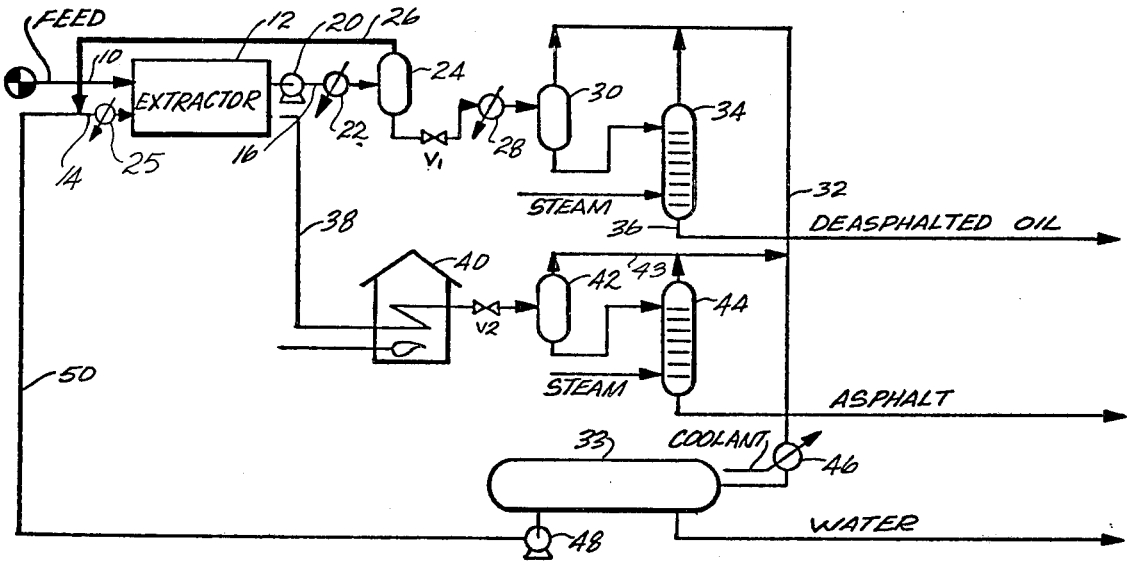
FIG. 1 is one schematic illustration of the hyrocarbon extraction system used in the process of this invention.

With reference to FIG. 1, the extraction of a residual feed contained in line 10 occurs in extractor 12 by contact with a solvent fed by line 14. Extractor 12 is maintained at an elevated temperature. There is formed in extractor 12 a light hydrocarbon-solvent fraction and a heavy hydrocarbon-solvent fraction. The heavy hydrocarbon-solvent fraction contains, in the typical case, asphalt, high molecular weight compounds, metal containing compounds, and inorganic matter. Light oil-solvent mix is recovered relatively free of the asphalt. Hydrocarbons normally paraffinic in nature, are then removed from the light oil-solvent mix.

To achieve this, the light oil-solvent mix is passed by pressuring pump 20 through line 16 to light oil-solvent mix preheater 22 where, in accordance with the invention, the mix is heated to an elevated temperature and pressure. Light oil-solvent mix is then passed to high pressure flash vaporizer 24 where a substantial portion of the solvent is separated by vaporization from the light oil at an elevated temperature and pressure and recycled by line 26 back to the solvent feed line 14.

The pressure in flash vaporizer 24 and the amount of solvent flash vaporized are controlled to provide, upon condensation of vapors and blending with recycle solvent, a blend at a temperature consonant with the requirements of extractor 12. At least 50% and preferably all of the heat requirements of the recycle solvent are provided by the condensed solvent. In the event additional heat is required due to a select deficiency in the amount of solvent evaporated, the additional heat may be provided ahead of extractor 12 by trim heater 25.

The balance of the light oil-solvent mix is then passed through valve $V_1$ where it is expanded and heated in heater 28 and passed to the light oil solvent flash drum 30. In flash drum 30, the major portion of the residual solvent is vaporized and enters line 32 which is part of a solvent recycle loop.

The light oil separated from flash vaporizer 30 is passed to light oil stripper 34 where, by the addition of steam, residual solvent is stripped from the light oil and combined with the solvent in line 32. The product light oil is removed in line 36 at the base of stripper 34.

Simultaneously, the heavy hydrocarbon-solvent mixture is passed by line 38 through fired heater 40 and to solvent flash drum 42 after passing through expansion valve $V_2$. In flash drum 42, a major portion of the solvent contained is released for passage by line 43 to line 32. A concentrated heavy hydrocarbon-solvent fraction is then passed to stripper 44 where upon addition of steam residual solvent is removed for passage to line 32. The combined solvent streams are collected in accumulator 33. The heavy hydrocarbon fraction is removed from the base of stripper 44.

The solvent in line 32 is typically condensed in heat exchanger 46 prior to collection in accumulator 33 where water contained in the solvent is separated by decantation.

The solvent is pumped, on an as required basis, by pump 48 through line 50 for feed to extractor 12.

In the process as described, it is particularly preferred to maintain a pressure in flash drum 24 which is from about 1 to about 50 psia above the pressure in extractor 12 to insure a positive flow of the initially vaporized solvent for combination with the solvent fed to extractor 12 in line 14. This results in a positive mixing action. The vapors in line 26 condense, and in doing so, transmit heat of condensation to the solvent in line 50 to provide a mixed solvent at a temperature in line 14 required by extractor 12. To achieve the desired pressure in drum 24 which is a function of temperatures, all of the heat required is normally provided by super heater 22.

As a consequence of the practice of this invention, the steam reheater employed for the cold solvent which would normally be used in line 50 is eliminated or made substantially smaller. In addition, it is unnecessary to use an external coolant to condense solvent vapors exiting flash drum 24. As a consequence of these modifications, the total heat requirements for the asphalting process may be reduced nearly half, and the investment for condensing apparatus be reduced to a similar extent.

Figure 2:
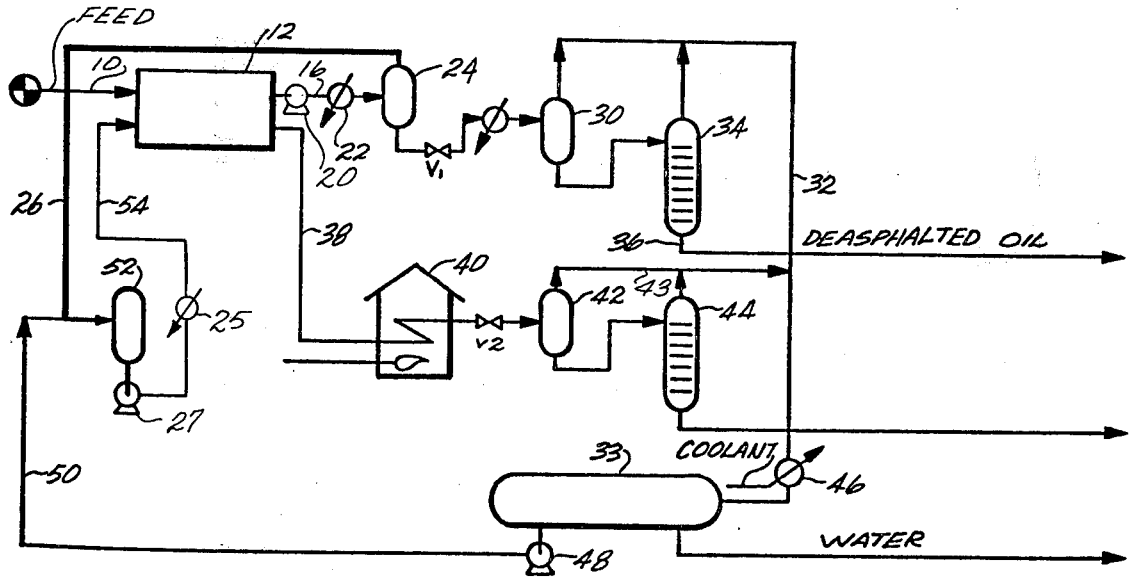
FIG. 2 is a modification of the system shown in FIG. 1.

The variation of the invention is depicted in FIG. 2. With reference thereto, extraction occurs under essentially the same conditions as described for FIG. 1. The required amount of the solvent is heated in heater 22 and vaporized in drum 24. The hot solvent vapors are mixed with cold solvent in accumulator 52 which causes vapors to condense allowing vapors to more intimately mix with the solvent in entering accumulator 52 in line 50 to achieve the desired temperature for feed by line 54 to extractor 12. Any heat deficiency is provided by trim heater 25.

Where the pressure of the return relatively cool solvent in line 50 is below extraction pressure, a relatively low pressure solvent evaporation can be utilized provided the pressure is sufficient to enable the vaporized solvent to combine with the returning solvent. To the extent the combined solvent mixture is a pressure below the extractor pressure, the pressure differential may be accounted for by pump 27.

The main criteria of the invention is that the pressure of the high pressure solvent evaporation stage to be selected to be sufficiently high to cause the vapors to condense at a temperature requisite for heating of the cold solvent stream. Since the cold solvent stream is primarily heated by condensation of vapors an external source of heat may be totally eliminated or minimized to a substantial degree.

EXAMPLE 1

For the deasphalting operation, there is used isobutane as a solvent. In this instance, extractor 12 operates at a temperature of 230° F and a pressure of 400 psia, the pressure being approximately 40 psia above the bubble point of the mixture contained therein.

Feed, upon selective extraction by isobutane, forms into a deasphalted mixed stream which is pumped to a pressure of 410 psi and heated to 245° F. Under these conditions the isobutane vaporizes in high pressure flash drum 24 at a controlled pressure of 410 psi and the generated vapors flow by line 26 for combination with the cold solvent fed to extractor 12 in line 14.

The amount of solvent vaporized in high pressure flash drum 24 is controlled such that the net temperature of the combined mixture would be 230° F. As a consequence, a steam reheater for the mass of the cold solvent is not employed nor is it necessary to use an external coolant to condense solvent vapors from flash drum 24.

EXAMPLE 2

Employing the same basic operating principles for the extractor 12, the operation shown in FIG. 2, is employed. In this instance high pressure flash drum 24 is operated at a temperature of 239° F and a pressure of 395 psia.

The vapors mix and condense in hot solvent accumulator 52 at a condensation temperature of 238° F which is slightly in excess of the solvent temperature required in extractor 12.

What is claimed is:

1. In a process for the deasphalting of a hydrocarbon feed wherein the feed is contacted with a liquefied low molecular weight solvent at an elevated temperature and pressure in an extraction zone, the quantity of solvent employed being sufficient to form a liquid deasphalted hydrocarbon oil-solvent mixture and a fluid heavy hydrocarbon-solvent mixture followed by recovery of solvent from each mixture for recycle to the extraction zone, the improved method of solvent recovery and recycle which comprises:

a. pressurizing and heating at least a portion of the elevated temperature, deasphalted hydrocarbon oil-solvent mixture from the extraction zone to a pressure and temperature above the temperature and pressure of the extraction zone;

b. evaporating a portion of the solvent from the pressurized, heated mixture in an evaporation zone maintained at a pressure and temperature above the pressure and temperature in the extraction zone;

c. condensing and combining the elevated pressure, evaporated solvent with residual, recycled cooled solvent recovered from the hydrocarbon oil-solvent and heavy hydrocarbon-solvent mixtures to form a liquid solvent mixture at a pressure sufficient for introduction to the extraction zone, the quantity of solvent evaporated in the evaporation zone being sufficient on condensation to furnish at least about 50% of the heat required to heat the recycled, cooled solvent to the temperature required for introduction to the extraction zone, and d. returning the liquid solvent mixture to the extraction zone at a temperature and pressure sufficient for deasphalting the hydrocarbon feed.

2. A process as claimed in claim 1 in which the amount of solvent evaporated in the evaporation zone is sufficient on condensation to furnish essentially all of the heat required to heat the recycled, cooled solvent to the temperature required for introduction to the extraction zone.

3. A process as claimed in claim 1 in which the solvent from the evaporation zone and the recycled cooled solvent are combined in an accumulation zone prior to introduction to the extraction zone.

4. A process as claimed in claim 1 in which the evaporation zone is maintained at a pressure of from about 1 to about 50 psi above the pressure in the extraction zone.

5. In a process for the deasphalting of hydrocarbon feeds wherein the feed is contacted with a liquefied low molecular weight solvent at an elevated temperature and pressure in an extraction zone, the quantity of solvent employed being sufficient to form a liquid deasphalted hydrocarbon oil-solvent mixture and a fluid heavy hydrocarbon-solvent mixture followed by recovery of solvent from each mixture for recycle to the extraction zone, the improved method of solvent recovery and recycle which comprises:

a. pressurizing and heating at least a portion of the elevated temperature, deasphalted hydrocarbon oil-solvent mixture to a temperature and pressure above the temperature and pressure of the extraction zone;

b. evaporating, in an evaporation zone, a portion of the solvent from the pressurized heated mixture at a temperature and pressure above the temperature and pressure of the extraction zone;

c. condensing and combining the evaporated solvent with residual, recycled cooled solvent recovered from the hydrocarbon oil-solvent and heavy hydrocarbon-solvent mixtures in an accumulation zone to form a liquid solvent mixture for introduction to the extraction zone, the quantity of solvent evaporated in the evaporation zone being sufficient on condensation to furnish at least about 50% of the heat required to heat the recycled, cooled solvent to the temperature required for introduction to the extraction zone, and d. pressurizing the liquid solvent mixture and returning the liquid solvent mixture to the extraction zone at a temperature and pressure sufficient for deasphalting the hydrocarbon feed.

6. A process as claimed in claim 5 in which the amount of solvent evaporated in the evaporation zone is sufficient on condensation to furnish essentially all of the heat required to heat the recycled, cooled solvent to the temperature required for introduction to the extraction zone.

7. A process as claimed in claim 5 in which the evaporation zone is maintained at a pressure of from about 1 to about 50 psi above the pressure in the accumulation zone.

* * * * *